US008777214B2

(12) United States Patent
Naoi

(10) Patent No.: US 8,777,214 B2
(45) Date of Patent: Jul. 15, 2014

(54) SHEET FEEDER AND IMAGE FORMING APPARATUS

(75) Inventor: Shinya Naoi, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 13/605,751

(22) Filed: Sep. 6, 2012

(65) Prior Publication Data

US 2013/0069302 A1 Mar. 21, 2013

(30) Foreign Application Priority Data

Sep. 15, 2011 (JP) ..... 2011-201733

(51) Int. Cl.
*B65H 1/08* (2006.01)

(52) U.S. Cl.
USPC ..... 271/147; 271/148; 271/157; 271/162

(58) Field of Classification Search
USPC ..... 271/157, 162, 147, 148
See application file for complete search history.

(56) References Cited

U.S. PATENT DOCUMENTS 4,273,323 A * 6/1981 Kaneko et al. ..... 271/157
8,360,416 B2 * 1/2013 Hayama ..... 271/147

FOREIGN PATENT DOCUMENTS

JP 3133838 6/1991
JP 4-246028 9/1992
JP 8127434 5/1996
JP 2007-91360 4/2007
JP 2007-261728 10/2007

OTHER PUBLICATIONS

Notification of Reason(s) for Refusal mailed Oct. 22, 2013, directed to JP Application No. 2011-201733; 4 pages.
Decision to Grant a Patent mailed Feb. 4, 2014, directed to JP Application No. 2011-201733; 6 pages.

* cited by examiner

*Primary Examiner* — Michael McCullough
*Assistant Examiner* — Howard Sanders
(74) *Attorney, Agent, or Firm* — Lucas & Mercanti, LLP

(57) ABSTRACT

A sheet feeder includes a feed roller for feeding a sheet and a lifting plate for lifting the sheet to be fed to a feeding height of the feed roller. This sheet feeder further includes a wire for raising the lifting plate and a winding member formed with a winding configuration section for winding the wire. This winding configuration section is provided with a high-position winding section for a high-position side in a lifting height of the lifting plate and a low-position winding section for a low-position side. The high-position winding section is larger in winding radius than the low-position winding section. Accordingly, a sheet feeder having a simple structure capable of rapidly moving down the lifting plate and preventing impact of the lifting plate and an image forming apparatus incorporating the sheet feeder can be provided.

20 Claims, 18 Drawing Sheets

SHEET FEEDER AND IMAGE FORMING APPARATUS

CROSS-REFERENCE TO RELATED APPLICATIONS

This application is based upon and claims the benefit of priority from the prior Japanese Patent Application No. 2011-201733 filed on Sep. 15, 2011, the entire contents of which are incorporated herein by reference.

BACKGROUND OF THE INVENTION

1. Field of the Invention

The present invention relates to a sheet feeder for supplying sheets for image forming to an image forming section and an image forming apparatus incorporating this sheet feeder. More particularly, it relates to a sheet feeder including a feed roller for feeding stored sheets one by one to the image forming section and a lifting plate for lifting the sheets up to a feeding height (position) at which each sheet is to be fed by the feed roller, the sheet feeder being arranged to raise the lifting plate by pull-up using a wire, and an image forming apparatus incorporating the sheet feeder.

2. Description of Related Art

In a sheet feeder of an image forming apparatus, an uppermost one of sheets stored therein is fed out by a feed roller. The sheets are stacked on a lifting plate and lifted up by the lifting plate. Irrespective of the number of stored sheets, accordingly, the uppermost sheet is placed in contact with the feed roller. In some sheet feeders, the lifting plate is raised, or moved upward, by pull-up using a wire. Specifically, a wire attached to the lifting plate is wound to raise the lifting plate, thereby lifting up the sheets.

Meanwhile, the sheet feeder is sometimes pulled out from the image forming apparatus in order to replenish sheets. When the sheet feeder is pulled out from the image forming apparatus, the lifting plate has to be rapidly lowered, or moved downward, to allow a user to easily replenish sheets. In some cases, some electrical parts or components are arranged under the lifting plate in the sheet feeder. In case the lifting plate remains moved up, a user may carelessly touch the electrical parts. Also to avoid such an accident, the lifting plate needs to be moved downward quickly.

This downward movement of the lifting plate is basically caused by its own weight and the weight of the sheets stacked thereon. In the case where a large amount of sheets are stacked, accordingly, the downward moving speed is apt to be fast and large impact is likely to occur when the lifting plate lands on a lower limit position. To avoid this, a braking member against the downward movement is provided to prevent the downward moving speed from becoming too fast even when a large amount of sheets are stacked. When the number of stacked sheets is close to zero, to the contrary, this braking member alone may make the downward moving speed too slow because excessive braking is caused. JP-A-8 (1996)-127434 therefore discloses a technique that a plurality of braking members are provided and the number of jointed braking members is changed by use of partially toothed gears according to circumstances.

However, the technique disclosed in JP-A-8(1996)-127434 requires a complicated structure and thus high cost due to the necessity of providing the plurality of braking members. This technique also needs a special component such as the partially toothed gears.

The present invention has been made to solve the above problems and has a purpose to provide a sheet feeder having a simple structure capable of rapidly moving downward a lifting plate and preventing impact of the same, and an image forming apparatus incorporating the sheet feeder.

SUMMARY OF THE INVENTION

To achieve the above purpose, one aspect of the invention provides a sheet feeder including a feed roller for feeding a sheet and a lifting plate for lifting the sheet to be fed up to a feeding height for the feed roller, the device including: a wire for raising the lifting plate; and a winding member formed with a winding configuration section for winding up the wire to raise the lifting plate, wherein the winding configuration section includes: a high-position winding section for winding the wire while the lifting plate is located on a high-position side in a lifting height; and a low-position winding section for winding the wire while the lifting plate is located on a low-position side in the lifting height, the high-position winding section having a larger radius than a radius of the low-position winding section.

In this sheet feeder, the wire is pulled by the weight of the lifting plate when the lifting plate moves downward from a high position so that a winding (taking-up) member is rotated in a direction to unwind (unreel) the wire. Rotational resistance of the winding member at that time acts as a braking force against downward movement of the lifting plate. Herein, the wire at an initial stage of downward movement is unwound from the high-position winding section having a large diameter in the winding member. Accordingly, the torque that makes the winding member rotate by the gravity of the lifting plate is large. In other words, the braking force against downward movement of the lifting plate is relatively small. However, at an ending stage of downward movement, the wire is unwound from the low-position winding section. Accordingly, the torque that makes the winding member rotate by the gravity of the lifting plate is small. In other words, the braking force against the downward movement of the lifting plate is relatively large.

Furthermore, the present invention is also directed to an image forming apparatus including aforementioned sheet feeders and an image forming section for forming an image on a sheet supplied from the sheet feeder.

According to the present invention, a sheet feeder having a simple structure capable of rapidly moving downward the lifting plate and preventing impact of the same, and an image forming apparatus incorporating the sheet feeder.

DESCRIPTION OF EMBODIMENTS

<First Embodiment>

Figure 1:
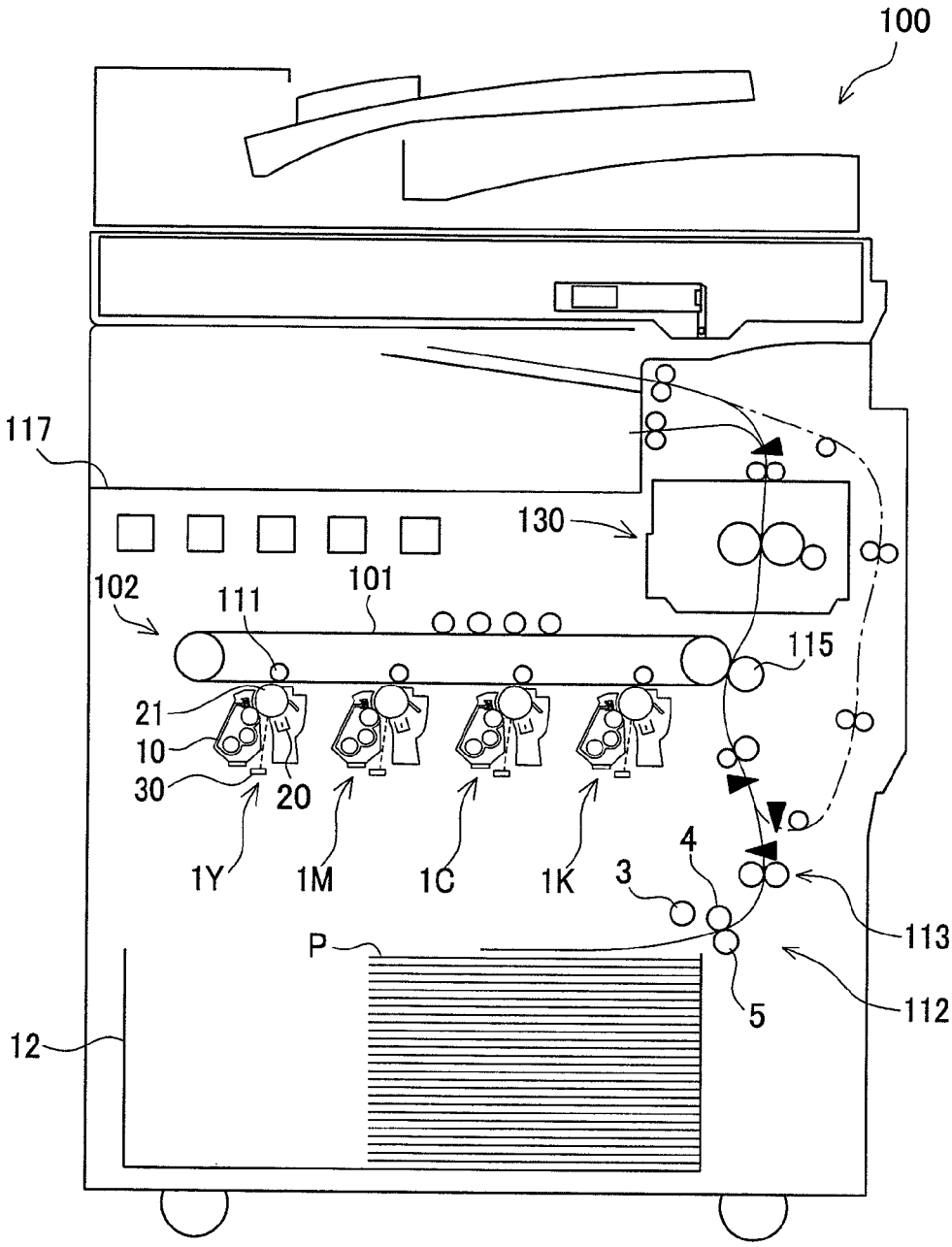
FIG. 1 is a structural diagram of a whole image forming apparatus in a first embodiment.

A detailed description of a preferred embodiment of the present invention will now be given referring to the accompanying drawings. In this embodiment, the invention is applied to a sheet feeding unit 112 of an image forming apparatus 100 shown in FIG. 1. The image forming apparatus 100 in a first embodiment shown in FIG. 1 includes an image forming section 102 and the sheet feeding unit 112. The image forming section 102 is configured to form a full-color image by use of an intermediate transfer belt 101 and four toner image forming sections 1Y, 1M, 1C, and 1K. Each of the toner image forming sections 1Y, 1M, 1C, and 1K includes a photoconductor drum 21, a charger 20, an exposing section 30, a developing device 10, and a primary transfer roller 111. The image forming section 102 further includes a secondary transfer roller 115 and a fixing device 130. An output tray 117 is provided above the image forming section 102.

The sheet feeding unit 112 is a section for supplying sheets one by one to the image forming section 102. The sheet feeding unit 112 is provided with a sheet tray 12 for storing therein sheets P. The sheet feeding unit 112 further includes a pick-up roller 3, a sheet feed roller 4, and a separating roller 5. The image forming apparatus 100 is further provided with a sheet conveying section 113 to feed a sheet from the sheet feeding unit 112 to the image forming section 102. The sheet tray 12 can be pulled out from the image forming apparatus 100 to allow a user to replenish sheets.

Figure 2:
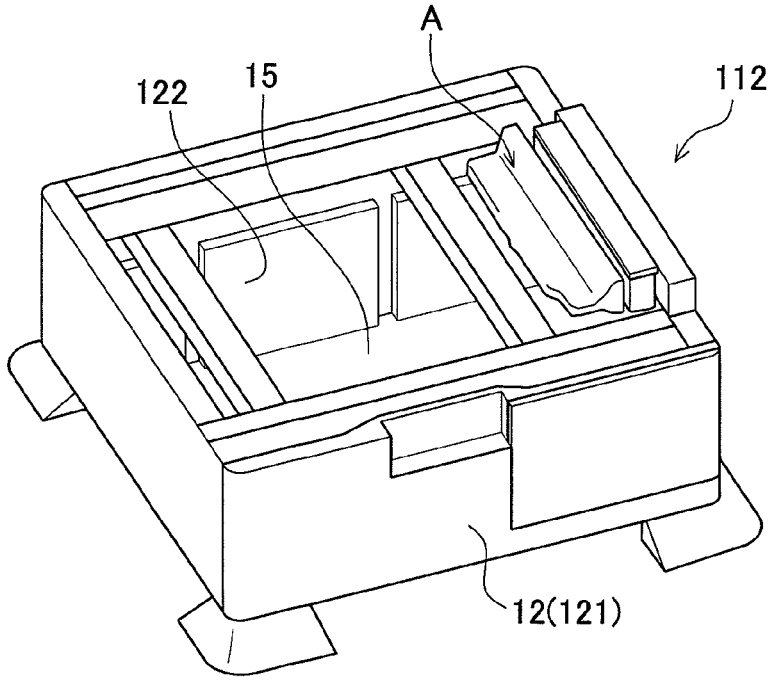
FIG. 2 is a partial perspective view showing a state where a sheet tray is not pulled out from a main body of the apparatus.
Figure 3:
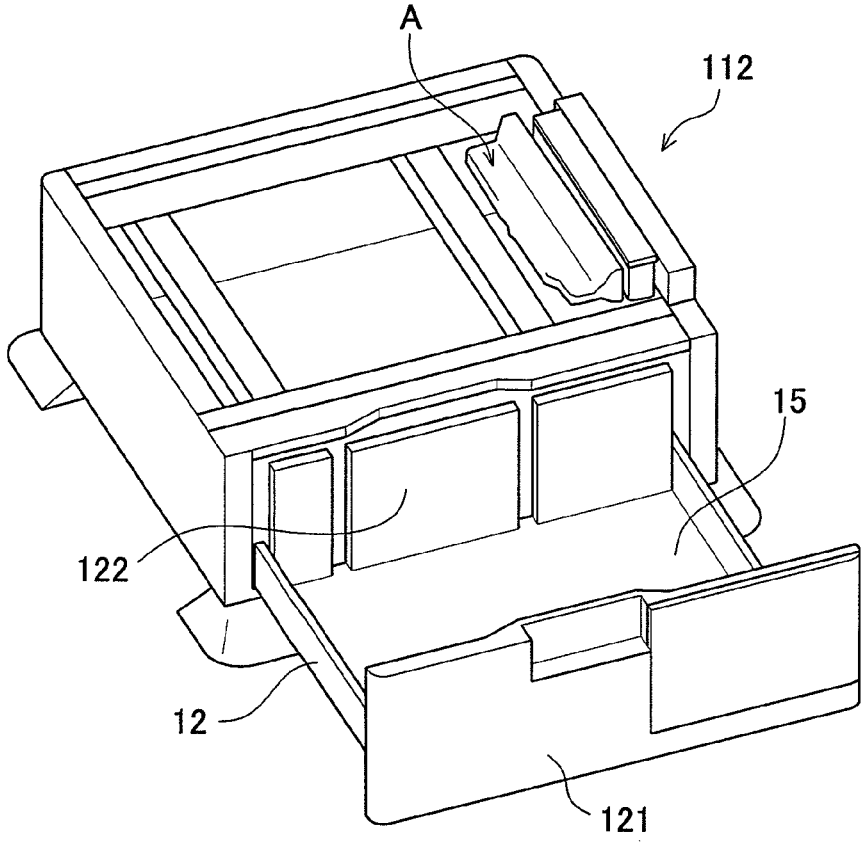
FIG. 3 is a partial perspective view showing a state where the sheet tray is pulled out from the main body.

FIG. 2 shows a state where the sheet tray 12 is not pulled out from the image forming apparatus 100 and FIG. 3 shows a state where the sheet tray 12 is pulled out from the image forming apparatus 100. FIGS. 2 and 3 illustrate only the sheet feeding unit 112 of the image forming apparatus 100 by omitting the image forming section 102 and others. The pick-up roller 3, sheet feed roller 4, and separating roller 5 shown in FIG. 1 are located in an area indicated by an arrow A in FIGS. 2 and 3. That is, they are not moved out together with the sheet tray 12. A lifting plate 15 is provided at the bottom of the sheet tray 12 to stack thereon the sheets P. The lifting plate 15 is used to lift up the stacked sheets P until an uppermost one of the sheets P comes in contact with the pick-up roller 3.

Figure 4:
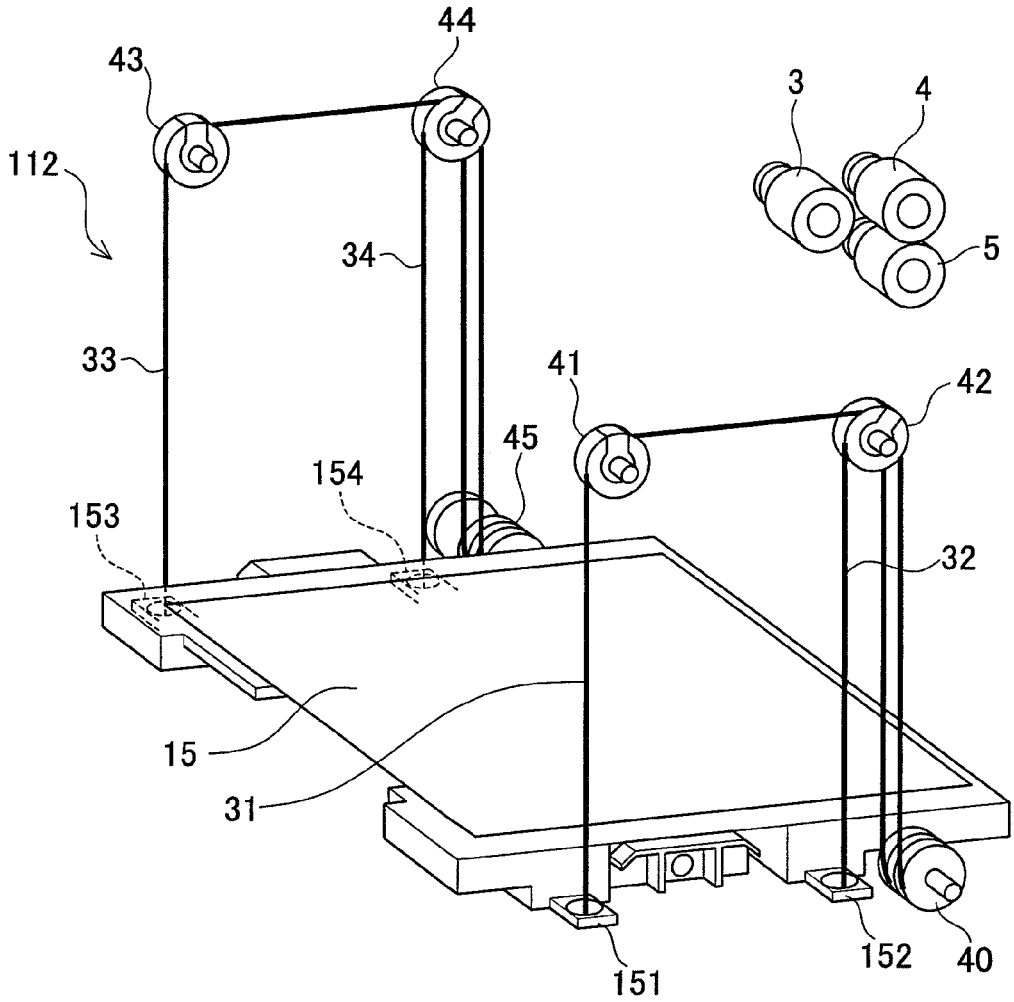
FIG. 4 is a perspective view showing a lifting mechanism of a lifting plate in a lowered state.

In the sheet feeding unit 112 of the present embodiment, a lifting operation of the lifting plate 15 is conducted by a wire winding system. A mechanism for this system is explained referring to FIG. 4. As shown in FIG. 4, in the sheet feeding unit 112 of the present embodiment, the lifting plate 15 is suspended by four wires 31-34. The wires 31 and 32 suspend two hooks 151 and 152 provided on a near side of the lifting plate 15 and the wires 33 and 34 suspend two hooks 153 and 154 provided on a far side of the same.

On the near side of the lifting plate 15, a winding pulley 40 is provided to wind up the wires 31 and 32. Driven pulleys 41 and 42 are placed above the near side of the lifting plate 15. The driven pulley 42 is located almost just above the winding pulley 40. The driven pulley 41 is located at almost the same level as the driven pulley 42 but more upstream than the driven pulley 42 in a feeding direction of the sheet P. The wire 31 is wound over the driven pulleys 41 and 42 to suspend the hook 151 of the lifting plate 15. The wire 32 is wound around only the driven pulley 42 to suspend the hook 152 of the lifting plate 15.

On the far side of the lifting plate 15, a winding pulley 45 is provided to wind up the wires 33 and 34. Furthermore, driven pulleys 43 and 44 are provided on the far side of the lifting plate 15. A positional relationship between the winding pulley 45 and the driven pulleys 43 and 44 is similar to a positional relationship between the winding pulley 40 and the driven pulleys 41 and 42. The placement of the wires 33 and 34 is also similar to that of the wires 31 and 32.

Figure 5:
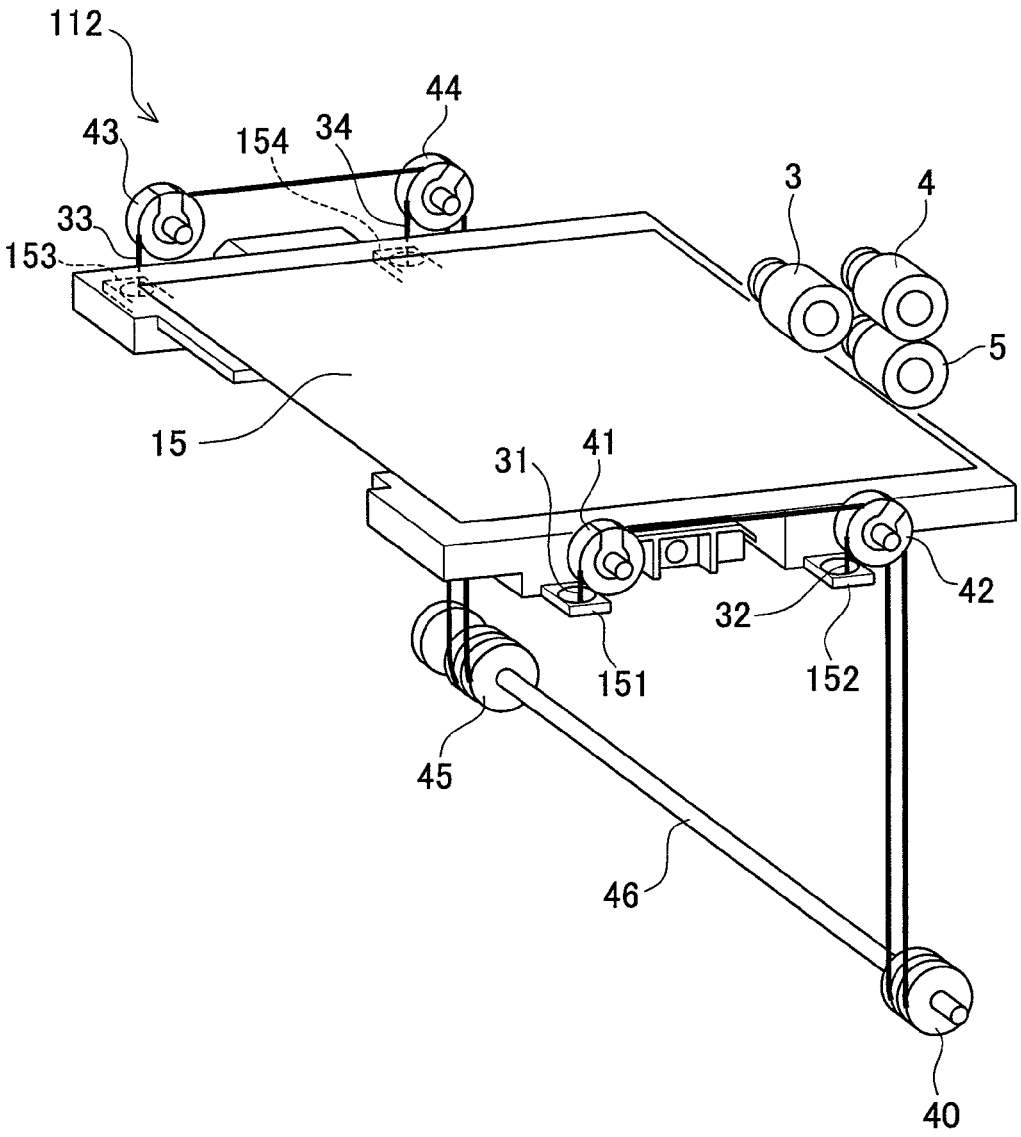
FIG. 5 is a view showing the lifting mechanism of the lifting plate in a raised state.

FIG. 4 illustrates a state where the lifting plate 15 is lowered to a lower limit position. FIG. 5 illustrates a state where the lifting plate 15 is raised to an upper limit position. Two winding pulleys 40 and 45 are attached to a common rotary shaft 46 as shown in FIG. 5. The winding pulleys 40 and 45 and the rotary shaft 46 are integrally rotated together. Accordingly, the lifting plate 15 suspended at the four hooks 151 to 154 by the wires 31 to 34 moves upward and downward while keeping its horizontal posture.

The winding pulleys 40 and 45, the rotary shaft 46, and the driven pulleys 41 to 44 are installed in the sheet tray 12. Thus, they are moved together with the sheet tray 12 when the sheet tray 12 is pulled out (opened) and then pushed in (closed). Specifically, all of the components shown in FIG. 4 or 5 excepting the pick-up roller 3, sheet feed roller 4, and separating roller 5 are moved together by the pulling and pushing (opening and closing) operations.

The winding pulley 40, the driven pulleys 41 and 42, and the wires 31 and 32 placed on the front side (the near side) are built in a front panel 121 shown in FIGS. 2 and 3. The winding pulley 45, the driven pulleys 43 and 44, and the wires 33 and 34 placed on the far side are hidden behind a rear plate 122 in FIGS. 2 and 3. The rotary shaft 46 is located under the lifting plate 15. Thus, the above components are normally invisible to users.

Figure 6:
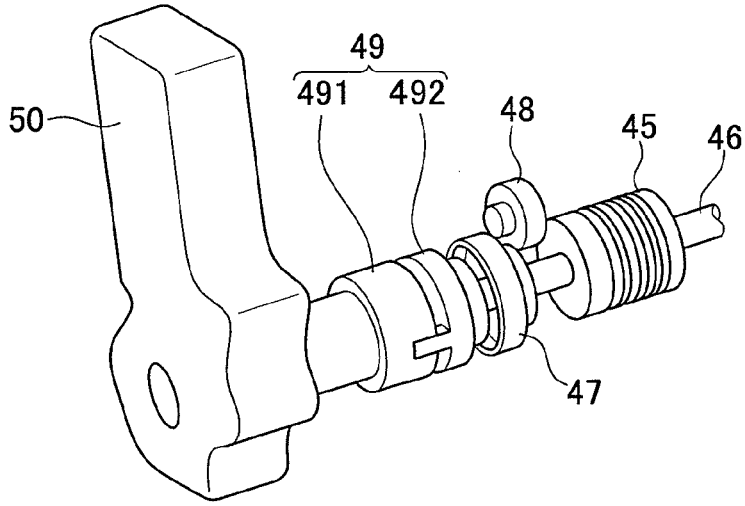
FIG. 6 is a perspective view showing a drive mechanism of a winding pulley in a state where a sheet tray is pushed in (closed)

Next, a drive mechanism for the winding pulleys 40 and 45 is explained referring to FIG. 6. On a farther side of the winding pulley 45 on the rotary shaft 46, an idle gear 47, a joint 49, and a motor 50 are provided as shown in FIG. 6. The idle gear 47 is attached with a damper 48. The joint 49 includes a driving member 491 located on a side close to the motor 50 and a driven member 492 located on a side close to the sheet tray 12. The joint 49 transmits a driving force from the motor 50 to the rotary shaft 46 by engagement between recesses and protrusions of the driving member 491 and the driven member 492.

The motor 50 generates a rotary driving force to rotate the rotary shaft 46. The motor 50 is rotated in a direction to cause the winding pulleys 40 and 45 to wind the wires 31 to 34, that is, in a direction to raise the lifting plate 15. The joint 49 is used to intermittently connect the motor 50 and the rotary shaft 46. The joint 49 shown in FIG. 6 is in a connected state. The idle gear 47 and the damper 48 generate a braking force against the rotation of the rotary shaft 46. For the damper 48 serving as a braking device, a known oil damper or the like is available.

The idle gear 47 and the damper 48 are preferably configured to be one way to produce a braking action only in one direction. To be concrete, they are preferably arranged to exert the braking force only against the rotation of the rotary shaft 46 in the unwinding direction of the winding pulleys 40 and 45 (in a direction to lower the lifting plate 15) but not to exert the braking force against the rotation of the same in the winding direction (in a direction to raise the lifting plate 15). This can be achieved by selecting the type of the damper 48 itself or adding a known one-way mechanism such as a ratchet to the idle gear 47. Another alternative is to make the idle gear 47 and the damper 48 engage with each other only when the sheet tray 12 is pulled out (i.e., the lifting plate 15 lowers), but disengage the damper 48 from the idle gear 47 when the sheet tray 12 is fully pushed in (i.e., the lifting plate 15 is raised). The following explanation is presupposed that the braking force generated by the idle gear 47 and the damper 48 is produced one way by any of the aforementioned means.

Figure 7:
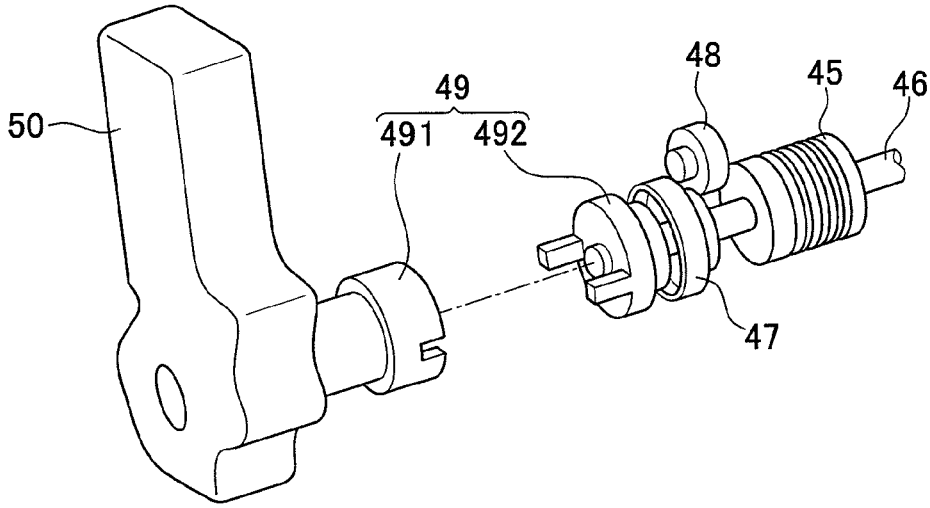
FIG. 7 is a perspective view showing the drive mechanism of the winding pulley in a state where the sheet tray is pulled out (opened)

As shown in FIG. 6, the motor 50 and the driving member 491 are placed in a main body of the apparatus. Accordingly, they do not move even when the sheet tray 12 is pulled out. On the other hand, the idle gear 47, the damper 48, and the driven member 492 are provided in the sheet tray 12 and thus moved together with the winding pulley 45 and others when the sheet tray 12 is pulled out (opened) and pushed in (closed). The arrangement in FIG. 6 corresponds to a closed state of the sheet tray 12. In an opened state of the sheet tray 12, the joint 49 is separated as shown in FIG. 7.

Figure 8:
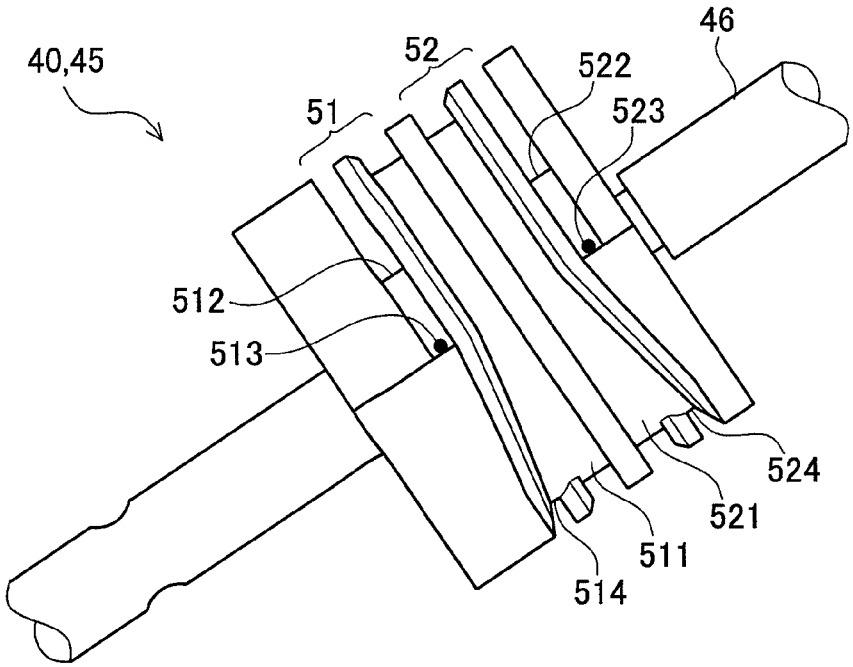
FIG. 8 is a front view of the winding pulley.

The winding pulleys 40 and 45 of the present embodiment are explained below. In this embodiment, the winding pulleys 40 and 45 are identical. Each of these winding pulleys 40 and 45 is formed with two groove-shaped winding threads 51 and 52 on a peripheral surface as shown in FIG. 8. Those threads 51 and 52 are rotated together when the winding pulley 40 (45) is rotated. Since the winding pulleys 40 and 45 are integrally rotated as mentioned above, therefore, a total of four threads 51 and 52 are rotated together.

The winding thread 51 is explained below. This thread 51 consists of an annular ring portion 511 and a spiral portion 512 branching therefrom in a spiral form. A wire outlet hole 513 is formed near an end of the spiral portion 512. This wire outlet hole 513 is a hole for attaching one end of any of the wires 31-34 to the winding pulley 40 (45) so as not to come off. The other ends of the wires 31-34 are fixed to the hooks 151-154 of the lifting plate 15.

Accordingly, when the winding pulley 40 (45) is rotated, the wire whose one end is attached to the wire outlet hole 513 is wound first on the spiral portion 512 of the winding thread 51. When the winding pulley 40 (45) is further rotated, the remaining portion of the wire is wound on the ring portion 511 of the winding thread 51. In the case where the winding pulley 40 (45) is rotated in a direction to unwind the wire, a portion of the wire wound on the ring portion 511 is first unwound and then a portion of the wire wound on the spiral portion 512 is unwound.

The other winding thread 52 in the winding pulley 40 (45) similarly consists of a ring portion 521 and a spiral portion 522. The spiral portion 522 is formed with a wire outlet hole 523. Accordingly, four wires 31-34 are wound one each on a total of four winding threads 51 and 52 of the winding pulleys 40 and 45. Specifically, each wire is wound on each thread as below:

Wire 31→Winding thread 51 of Winding pulley 40,
Wire 32→Winding thread 52 of Winding pulley 40,
Wire 33→Winding thread 51 of Winding pulley 45, and
Wire 34→Winding thread 52 of Winding pulley 45.

A lowered state of the lifting plate 15 shown in FIG. 4 corresponds to a state where the wires 31-34 are almost fully wound off. On the other hand, a raised state of the lifting plate 15 shown in FIG. 5 corresponds to a state where the wires 31-34 are almost fully wound up.

Figure 9:
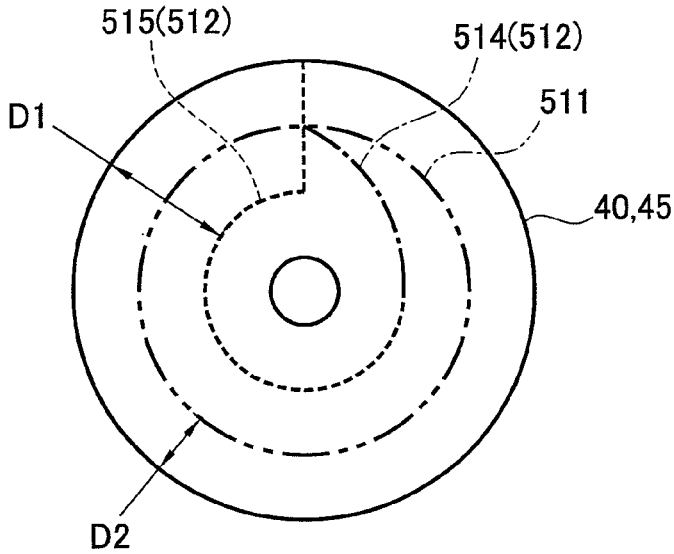
FIG. 9 is a perspective view to explain the depth of a winding thread in the winding pulley.

The winding threads 51 and 52 are further explained. The winding thread 51 has a non-uniform depth different according to portions. FIG. 9 is a perspective view of the winding pulley 40 (45) seen in an axial direction. In the winding thread 51, as shown in FIG. 9, the depth D1 of the spiral portion 512 is deeper than the depth D2 of the ring portion 511. The winding thread 51 includes a sloping zone 514 (a part of the spiral portion 512) providing a gently changing depth between a deep zone 515 having the depth D1 (a part of the spiral portion 512) and a shallow zone (the ring portion 511) having the depth D2. In FIG. 9, the depth-D1 zone is indicated by a broken line, the sloping zone 514 is indicated by a one-dot chain line, and the depth-D2 zone is indicated by a two-dot chain line. The winding thread 52 also has the same depth distribution. However, FIG. 9 is a mere explanatory diagram and does not illustrate each part correctly in proportion to their actual sizes.

Figure 10:
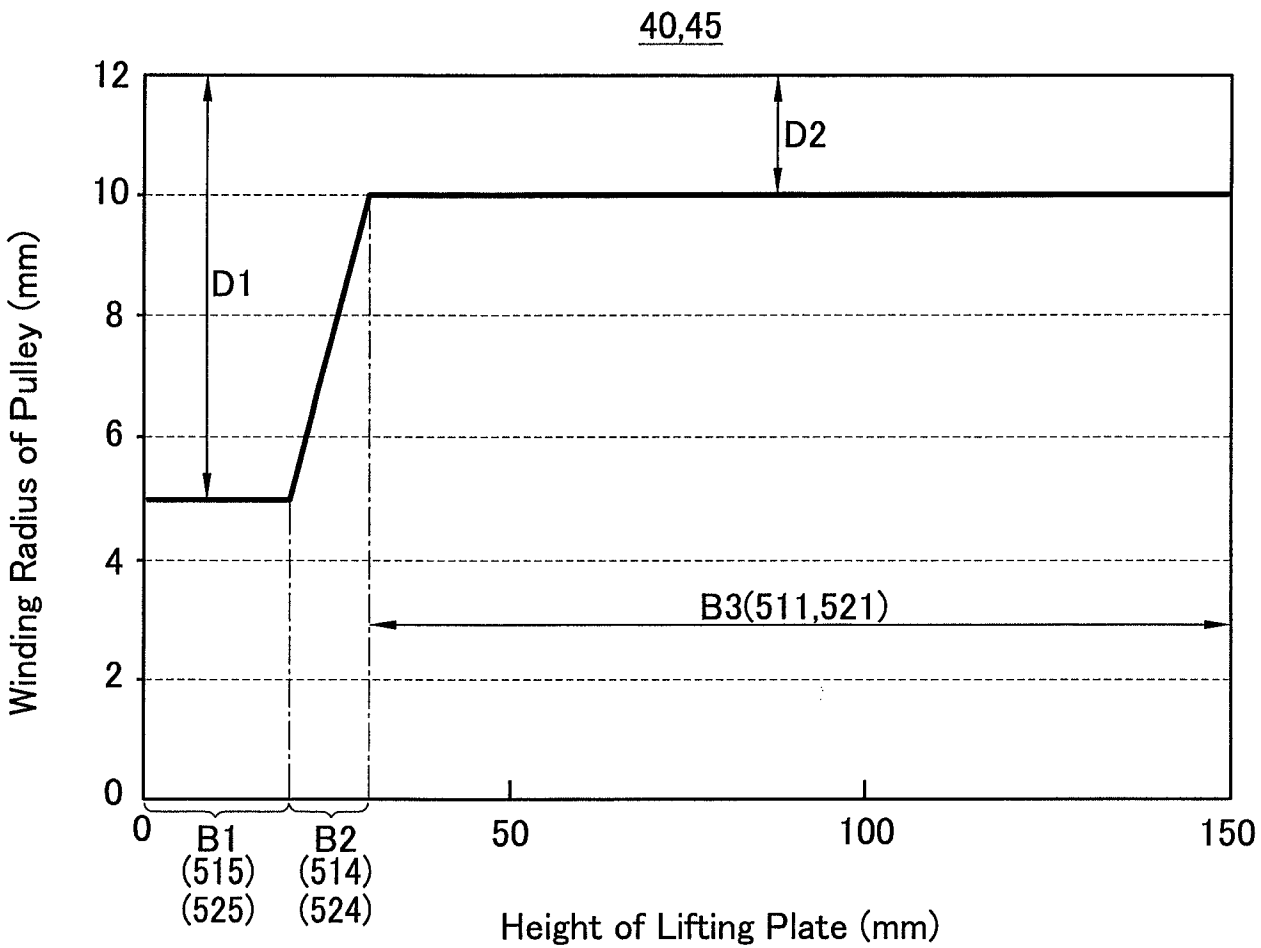
FIG. 10 is a graph showing a relationship between winding radius of the winding pulley and height of the lifting plate.

In the winding pulley 40 (45), there is established such a relationship that the winding radius is small at a deep part while it is large at a shallow part. FIG. 10 is a graph showing a relationship between the winding radius in the winding pulley 40 (45) and the raising height of the lifting plate 15. In this graph, a lateral axis indicates the raising height of the lifting plate 15 and a vertical axis indicates the winding radius of the winding pulley 40 (45). In FIG. 10, the radius of the outer shape of each winding pulley 40, 45 is set to 12 mm.

According to FIG. 10, in a zone B1 in which the height (position) of the lifting plate 15 is changed from 0 mm (i.e., a lower limit position) to about 20 mm, an effective winding radius is 5 mm. This is a zone in which the wires 31-34 are wound up on or wound off from the spiral portions 512 and 522 (depth D1) of the threads 51 and 52 in the zones 515 and 525. That is, the depth D1 is 7 mm.

In the zone B2 in which the height (position) of the lifting plate 15 is changed from about 20 mm to about 30 mm, the winding radius is continuously changed from 5 mm to 10 mm diagonally right up. This is a zone in which the wires 31-34 are wound on or wound off from the sloping zone 514 of the spiral portions 512 and 522 of the threads 51 and 52. In the zone B3 in which the height of the lifting plate 15 is changed from about 30 mm to about 150 mm (an upper limit position), the effective winding radius is 10 mm. This is a zone in which the wires 31-34 are wound on or wound off from the ring portions 511 and 521 (depth D2) of the threads 51 and 52. That is, the depth D2 is 2 mm.

Operations of the image forming apparatus 100 in the present embodiment are explained below. When image forming is to be executed by the image forming apparatus 100, the sheets P are stacked on the lifting plate 15 of the sheet tray 12, and then the sheet tray 12 is pushed into the closed state as shown in FIG. 2. In the closed state of the sheet tray 12, the joint 49 is in the connected state as shown in FIG. 6. It is to be noted that recesses and protrusions of the driving member 491 and the driven member 492 do not always come to engagement to bring the joint 49 into the connected state as soon as the sheet tray 12 is pushed in. However, at least one of the driving member 491 and the driven member 492 is allowed to withdraw a little in an axial direction. When the motor 50 starts to rotate as mentioned later, accordingly, the recesses and protrusions of the driving member 491 and the driven member 492 are allowed to engage with each other into the connected state.

In the image forming apparatus 100, accordingly, the winding pulleys 40 and 45 are driven by the motor 50 to wind the wires 31-34. That is, the lifting plate 15 is raised. Thus, the lifting plate 15 comes to the raised state shown in FIG. 5. During this raising, the existence of the damper 48 does not cause resistance to the rotation of the motor 50, because the braking force of the damper 48 acts one way as described above. Raising the lifting plate 15 is continued until an uppermost one of the stored sheets P contacts with the pick-up roller 3. In this state, image forming is conducted. As the number of the sheets P stacked on the lifting plate 15 decreases in the image forming, accordingly, the wires 31-34 are wound up little by little so that an uppermost one of the sheets P remains in contact with the pickup roller 3.

Figure 11:
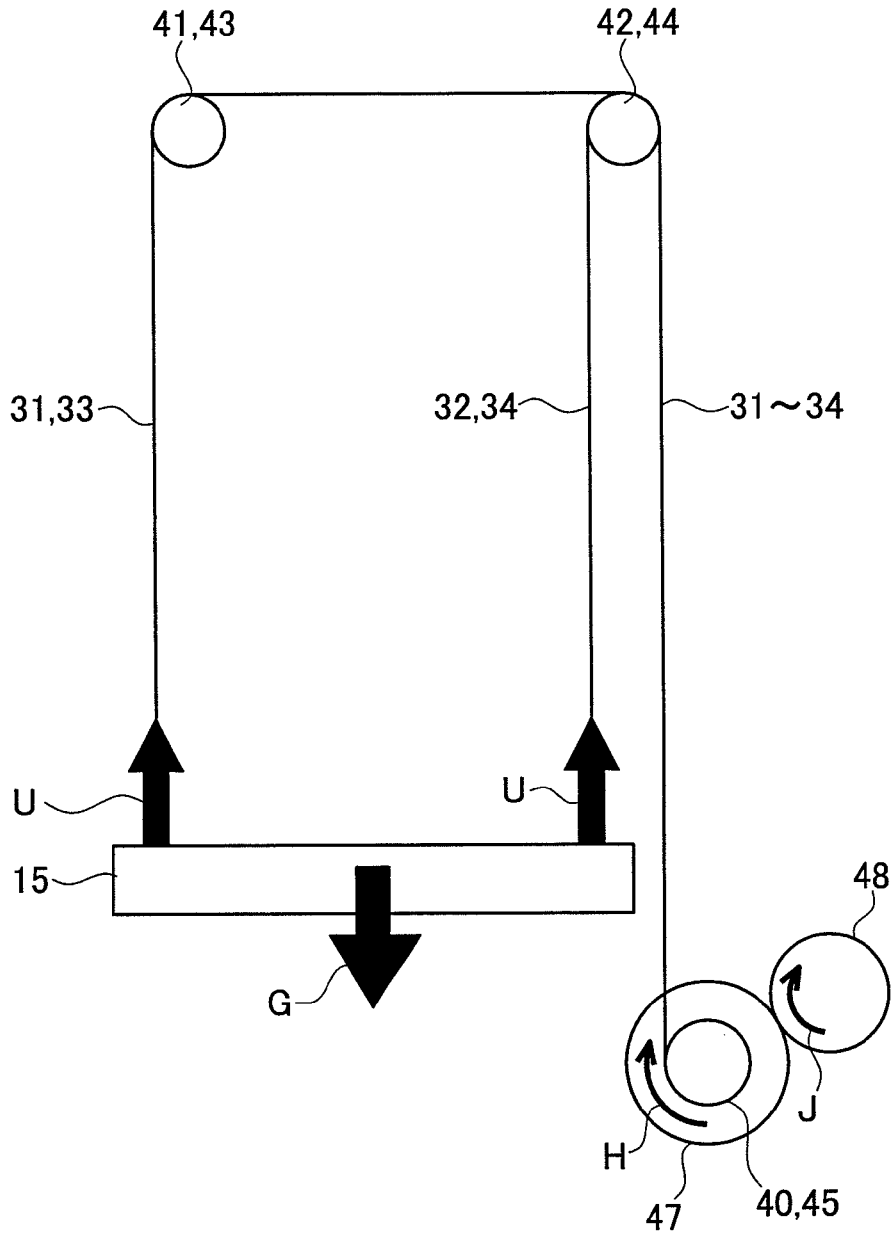
FIG. 11 is a schematic view to explain a force exerted on the lifting plate during downward movement.

When sheets P are to be added in the sheet tray 12, the sheet tray 12 is pulled (opened) by a user into a state shown in FIG. 3. This places the joint 49 in the separated state shown in FIG. 7. Thus, the lifting plate 15 cannot be kept in the raised state because the winding pulleys 40 and 45 are separated from the motor 50. Accordingly, the lifting plate 15 is going to move downward by its own weight as shown in FIG. 11. Thus, the wires 31-34 are pulled, thereby rotating the winding pulleys 40 and 45 in the unwinding direction (an arrow H in FIG. 11). The wound wires 31-34 are thus unwound, and the lifting plate 15 moves downward to a lowered state shown in FIG. 4.

At that time, the braking force (an arrow J in FIG. 11) of the damper 48 acts against the rotation of the winding pulleys 40 and 45 in the unwinding direction. This braking force J acts as upward force U on the lifting plate 15 via the wires 31-34. The lifting plate 15 therefore moves downward by its own weight G but does not freely fall down. In other words, the lifting plate 15 moves downward under the braking force U of the damper 48. This reduces noise and impact caused when the lifting plate 15 lands on (comes at) the lower limit position.

Furthermore, the braking force U of the damper 48 does not uniformly acts from start to end of the downward movement because the specially designed winding pulleys 40 and 45 as described above are used in the present embodiment. Accordingly, while the lifting plate 15 is in a relatively high position for a while from the start of downward movement, the braking force U does not act so strongly. As the position of the lifting plate 15 lowers and approaches the lower limit position, thereafter, the braking force U rises prior to landing of the lifting plate 15 on the lower limit position.

Specifically, for a while from the start of downward movement, the wires 31-34 are unwound from the ring portions 511 and 521 of the winding threads 51 and 52. This corresponds to the zone indicated as the zone B3 in FIG. 10. For this period, the effective radius of each of the winding pulleys 40 and 45 for the wires 31-34 is as relatively large as 10 mm as explained in FIG. 10. Therefore, a relatively large torque acts on the winding pulleys 40 and 45 by the weight G of the lifting plate 15. In other words, the braking force U of the damper 48 is relatively weak for the lifting plate 15.

When the lifting plate 15 moves downward to a position corresponding to the zone B2 in FIG. 10, the wires 31-34 are unwound from the sloping zone 514 of the spiral portions 512 and 522 of the threads 51 and 52. Thus, the effective radius of the winding pulleys 40 and 45 is decreased and also the torque to the winding pulleys 40 and 45 by the gravity G of the lifting plate 15 is also decreased. To the contrary, the braking force U of the damper 48 exerted on the lifting plate 15 rises.

When the lifting plate 15 further moves downward to a position corresponding to the zone B1 in FIG. 10, the wires 31-34 are unwound from the zones 515 of the spiral portions 512 and 522. At this stage, the effective radius of each of the winding pulleys 40 and 45 is as very small as 5 mm as explained in FIG. 10. The torque applied to the winding pulleys 40 and 45 by the gravity G of the lifting plate 15 is very weak. To the contrary, the braking force U of the damper 48 exerted on the lifting plate 15 is quite strong.

Figure 12:
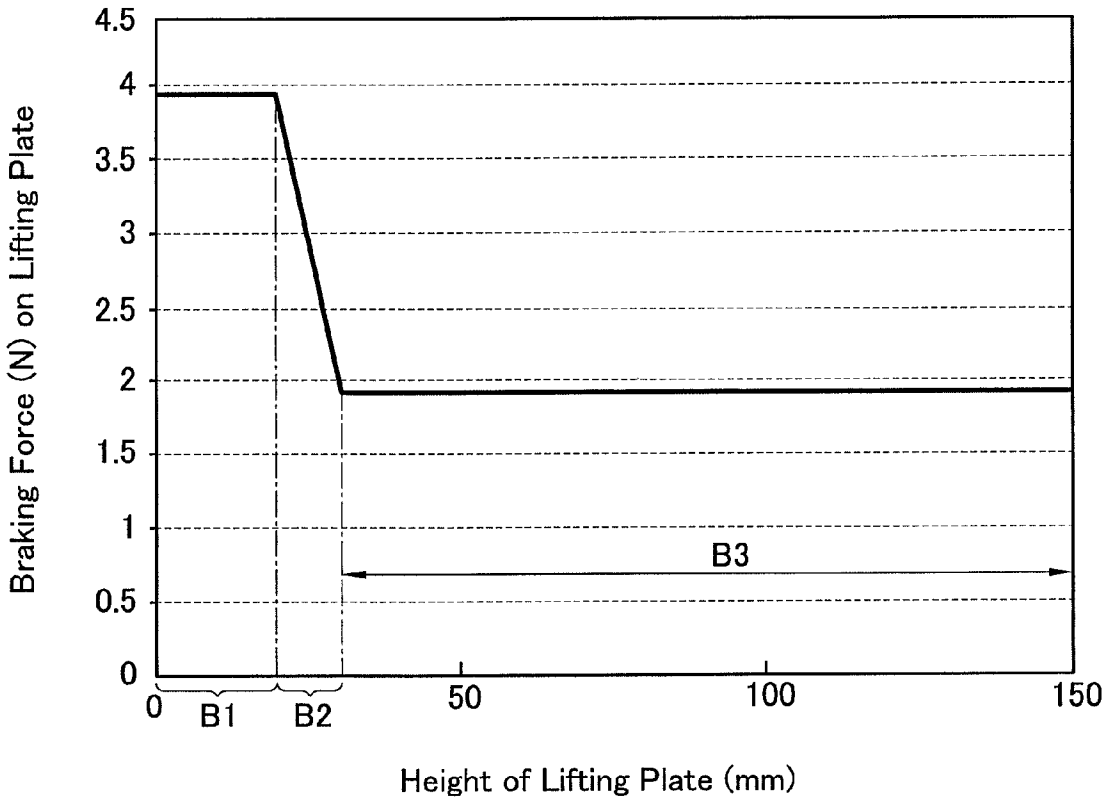
FIG. 12 is a graph showing a relationship between a braking force exerted on the lifting plate and the height of the lifting plate.

FIG. 12 is a graph showing a change pattern of the above braking force U. In this graph, a lateral axis indicates the height (position) of the lifting plate 15 as in FIG. 10, and a vertical axis indicates the braking force U (in the unit: N (newton)) exerted on the lifting plate 15. According to FIG. 12, the braking force U is about 1.9 N for the zone B3, about 3.9 N for the zone B1, and continuously rises from 1.9 N to 3.9 N as the lifting plate 15 is lowered for the zone B2 between B1 and B3. The damper 48 which is a source of the braking force U simply generates the braking force as resistance against the rotation of the idle gear 47 following the rotation of the winding pulleys 40 and 45. Therefore, the braking force U does not stop the lifting plate 15 in the course of downward movement.

The above configurations provide the following advantages. The braking force U of the damper 48 does not act so much for a while from the start of downward movement of the lifting plate 15. Accordingly, the time needed to lower the lifting plate 15 is reduced. On the other hand, just before the lifting plate 15 lands on the lower limit position, the braking force U of the damper 48 rises. This reliably reduces noise and impact caused at the time of landing-on of the lifting plate 15. Specifically, both rapid lowering and soft landing of the lifting plate 15 are achieved. Since the lifting plate 15 rapidly moves downward, a user is less likely to touch any electrical mechanical parts or components even if they are provided under the lifting plate 15. On the other hand, the damper 48 is a single necessary braking member and simple in structure. Further, downward movement itself of the lifting plate 15 is caused by its own weight acting as a driving force. Any energy source and any control system for the downward moving operation are not required.

In reality, the damper 48 itself is not indispensable. For instance, sliding resistance on portions bearing the rotary shaft 46 also practically acts as a braking force against the rotation of the winding pulleys 40 and 45. Accordingly, when this sliding resistance is large to a certain degree, it can eliminate the need for the damper 48.

Furthermore, the winding pulleys 40 and 45 are provided respectively with the sloping zones 514 and 524 between the large-diameter (radius) zone (the ring portions 511 and 521) of the threads 51 and 52 and the small-diameter (radius) zone (the zone 515 and 525 of the spiral portions 512 and 522). Therefore, the braking force U rises continuously, but not discontinuously, from a weak state to a strong state. Thus, the rise of the braking force U itself does not cause impact.

Figure 13:
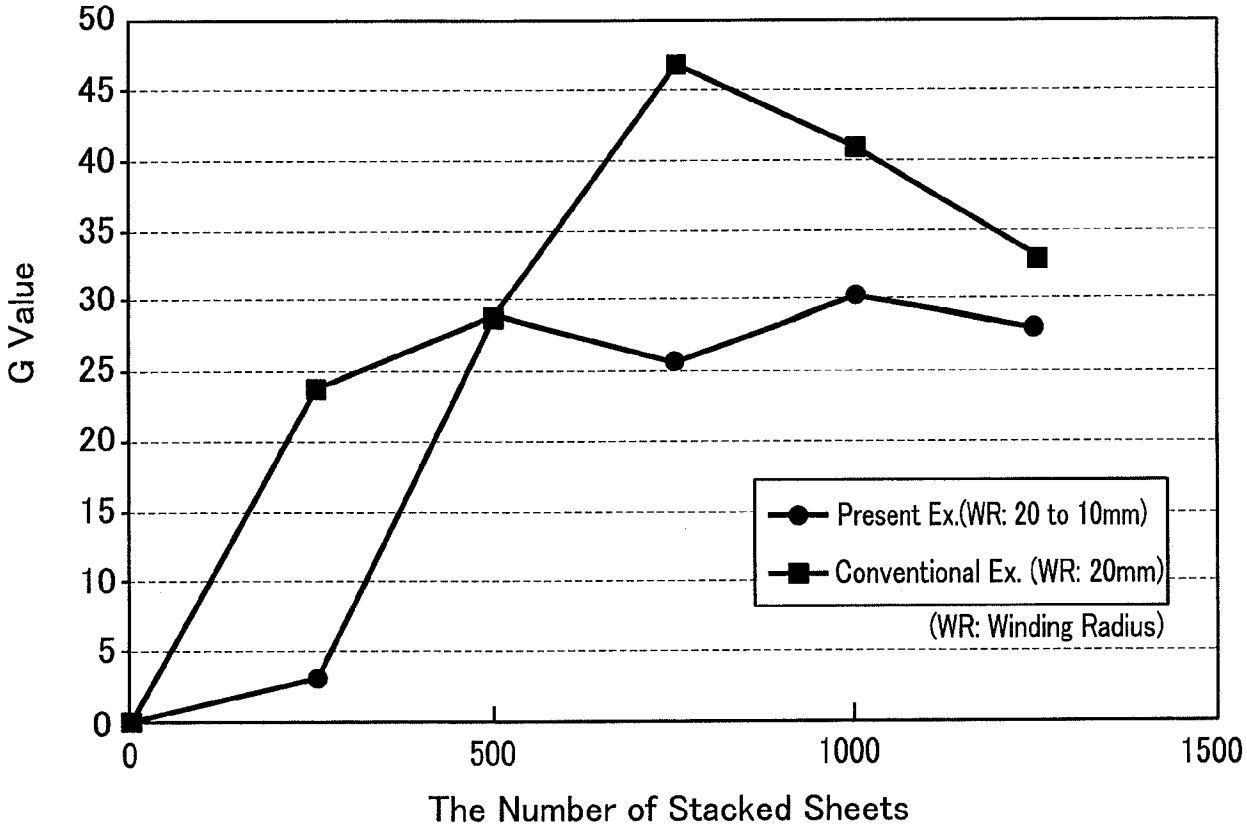
FIG. 13 is a graph showing a degree of impact occurring when the lifting plate lands on a lower limit position by comparison between the embodiment and a conventional art.

The effects of reducing impact of the lifting plate 15 at the time of landing are shown in a graph of FIG. 13. This graph shows the impact power on the lifting plate 15 at the time of landing by comparison between an example of the present invention (a present example) and an example of a conventional art (a conventional example). In this graph, a lateral axis indicates the number of the sheets P stacked on the lifting plate 15 and a vertical axis indicates the magnitude of impact power (G(gravitational acceleration) value). In a test shown in the graph of FIG. 13, as the present example, the winding pulleys 40 and 45 each having an effective radius of 20 mm for the zone B3 and an effective radius of 10 mm for the zone B1 are used. As the conventional example, a winding pulley having a constant effective radius of 20 mm is used. All other conditions are common between the present example and the conventional example.

FIG. 13 reveals that in the conventional example the impact power is largest when the number of stacked sheets is about 750, whereas in the present example the impact power is substantially constant when the number of stacked sheets is 500 or more. This impact power in the present example is about half the largest impact power in the conventional example. This shows that the impact power in the present invention is reduced reliably. Incidentally, it is also found in the conventional example in FIG. 13 that when the number of stacked sheets exceeds 750, the impact power tends to rather weaken. This seems because when the number of stacked sheets is as large as exceeding 750, the height (position) of the lifting plate 15 is low at the start of downward movement.

<Second Embodiment>

Figure 14:
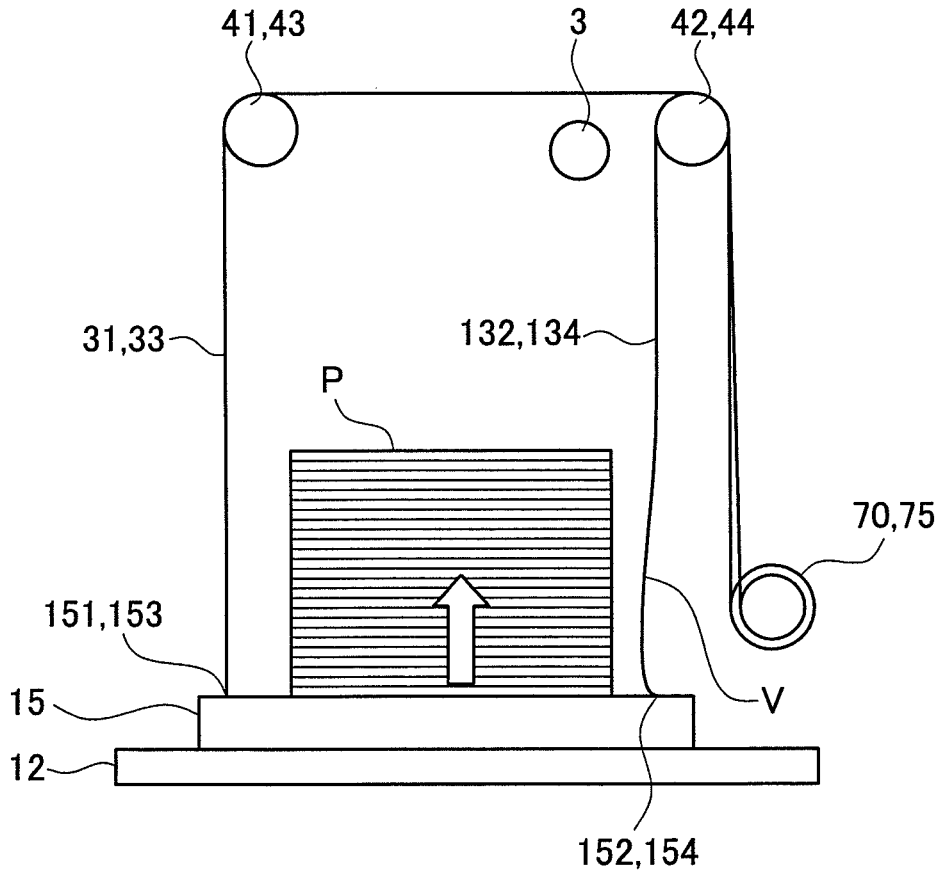
FIG. 14 is a schematic diagram showing differences of an image forming apparatus in a second embodiment from the first embodiment.

A second embodiment of the present invention will be explained below, which is different in the following two configurations from the first embodiment. A first difference is in that wires 132 and 134 each having slack V are used instead of the wires 32 and 34 as shown in FIG. 14. A second difference is in that winding pulleys 70 and 75 slightly different in configuration from the pulleys 40 and 45 of the first embodiment are used as winding pulleys. The second embodiment excepting the above is basically identical to the first embodiment. Therefore, identical or similar parts or components to those in the first embodiment excepting the winding pulleys 70 and 75 are given the same reference signs as those in the first embodiment.

The first difference is explained first. FIG. 14 is a schematic diagram showing a lowered state of the lifting plate 15 in the second embodiment. FIG. 14 illustrates only necessary parts for explaining the differences from the first embodiment (the same applies to FIGS. 16-20). Since the wires 132 and 134 in the present embodiment have slack V, they are slightly longer than the wires 32 and 34 in the first embodiment. The wires 31 and 33 in the present embodiment have the same length as those in the first embodiment. That is, the wires 31 and 33 in this embodiment are also not slackened.

The second difference, i.e., the winding pulleys 70 and 75 in the present embodiment, is next explained. The winding pulleys 70 and 75 are slightly different from the winding pulleys 40 and 45 in the first embodiment and are almost identical in external appearance to the winding pulleys 40 and 45 shown in FIG. 8. Specifically, each of the winding pulleys 70 and 75 has two winding threads as with the winding pulleys 40 and 45. Similarly, each winding thread also consists of the ring portion and the spiral portion. In the following explanation, the threads of the winding pulleys 70 and 75 are also given the same reference signs as those of the threads 51 and 52 of the winding pulleys 50 and 45.

The winding pulleys 70 and 75 are different from the winding pulleys 40 and 45 in winding radius of a winding thread. In each winding pulley 40, 45 in the first embodiment, both the two threads 51 and 52 have the same radius distribution as shown in FIG. 10. In each winding pulley 70, 75 in the second embodiment, however, two threads 51 and 52 do not have the same radius distribution. To be concrete, each of the winding pulleys 70 and 75 has a different radius zone in which the winding threads 51 and 52 are different in radius.

Figure 15:
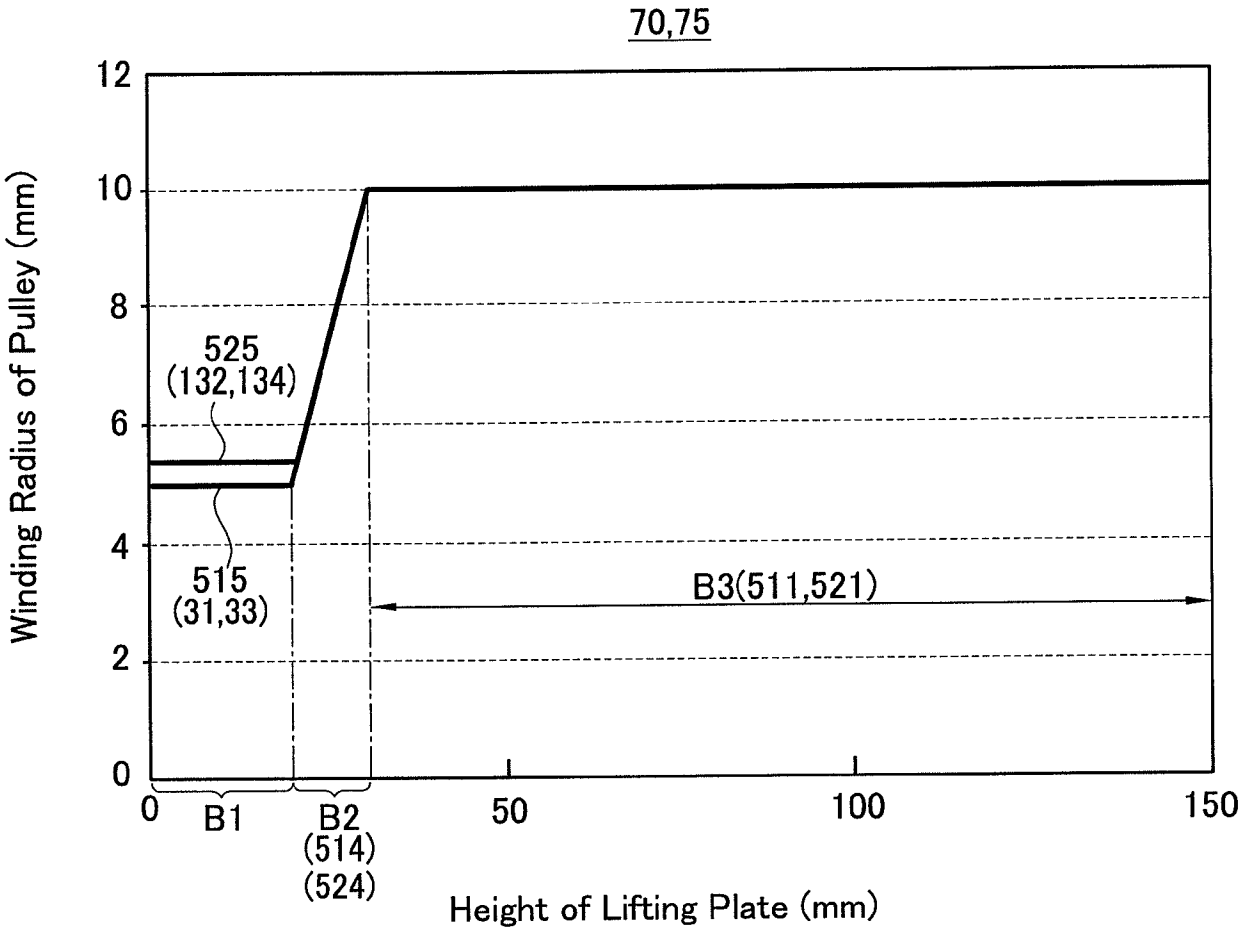
FIG. 15 is a graph showing one example of a relationship between winding radius of a winding pulley and height of a lifting plate in the second embodiment.

The radius distribution of the winding threads 51 and 52 in the winding pulleys 70 and 75 is explained in a graph of FIG. 15. In FIG. 15, as in FIG. 10, the radius of the outer shape of each of the winding pulleys 70 and 75 is set to 12 mm. In FIG. 15, the different radius zone in which the threads 51 and 52 are different in winding radius is a zone B1. Specifically, the zone B1 corresponds to a flat zone 515 (525) of the spiral portion 512 (522) of the threads 51 and 52, not a sloping zone B2. This is a zone for the height (position) of the lifting plate 15 changing from 0 mm to 20 mm. In this zone, the thread 52 on which the wire 132 (134) is wound has a larger diameter than the thread 51 on which the wire 31 (33) is wound. On the other hand, the winding threads 51 and 52 have no difference in winding radius in the sloping zones 514 and 524 (B2) of the spiral portions 512 and 522 and in the ring portions 511 and 521 (B3).

In the above respects, the second embodiment differs from the first embodiment. The second embodiment has a different feature from the first embodiment in the posture of the lifting plate 15 during upward/downward movement. The posture of the lifting plate 15 moving upward from a lower limit position is first explained. The lifting plate 15 is moved upward by a driving force of the motor 50 when the sheet tray 12 is pushed in (closed) as shown in FIG. 2. While the lifting plate 15 is in the lower limit position, as shown in FIG. 14, the lifting plate 15 itself is held horizontal even though the wires 132 and 134 have the slack V. It is to be noted that FIG. 14 illustrates that the sheets P are fully stacked on the lifting plate 15.

Figure 16:
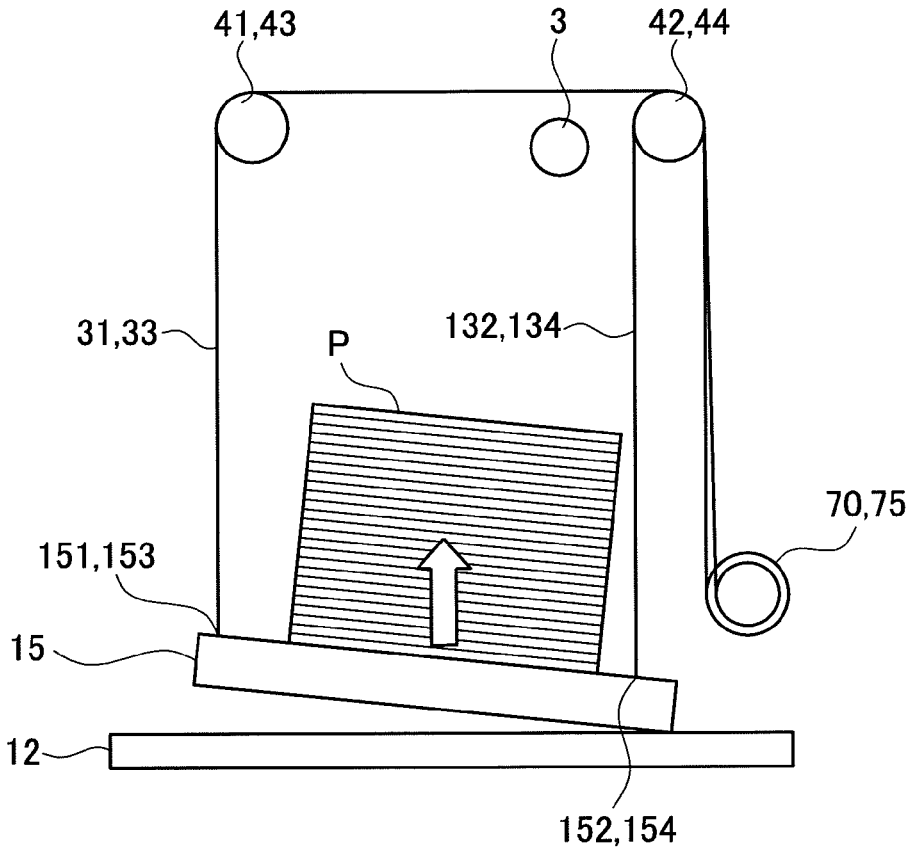
FIG. 16 is a schematic diagram (Part 1) to explain the posture of the lifting plate during upward and downward movement in the second embodiment.

When the wires 132, 134, 31, and 33 start to be wound by the winding pulleys 70 and 75, the lifting plate 15 also starts to move upward. Until the slacks V disappear and the wires 132 and 134 tighten up, however, the end portion of the lifting plate 15 close to the hooks 152 and 154 does not move upward, whereas the end portion of the plate 15 close to the hooks 151 and 153 moves upward. FIG. 16 shows a situation at the time when the slacks V disappear. In this situation, the end portion close to the hooks 152 and 154 is still in contact with the sheet tray 12, whereas the end portion close to the hooks 151 and 153 is separated from the sheet tray 12. Accordingly, the lifting plate 15 is inclined. Thereafter, the lifting plate 15 moves upward as being held in this inclined state.

However, at this time, the wires 132, 134, 31, and 33 are wound up on the threads 51 and 52 of the winding pulleys 70 and 75 in the zone B1 (515 and 525) shown in FIG. 15, that is, the different radius zone. Accordingly, there is a difference in effective winding radius between the winding threads 51 and 52. That is, the thread 52 for winding up the wires 132 and 134 is larger in radius than the other thread 51. Thus, the winding speed of the wires 132 and 134 is faster than that of the wires 31 and 33. This means that the upward moving speed of the hooks 152 and 154 is faster than that of the hooks 151 and 153 in the lifting plate 15. Therefore, following the state shown in FIG. 16, the inclination of the lifting plate 15 fades away as the lifting plate 15 moves upward.

Figure 17:
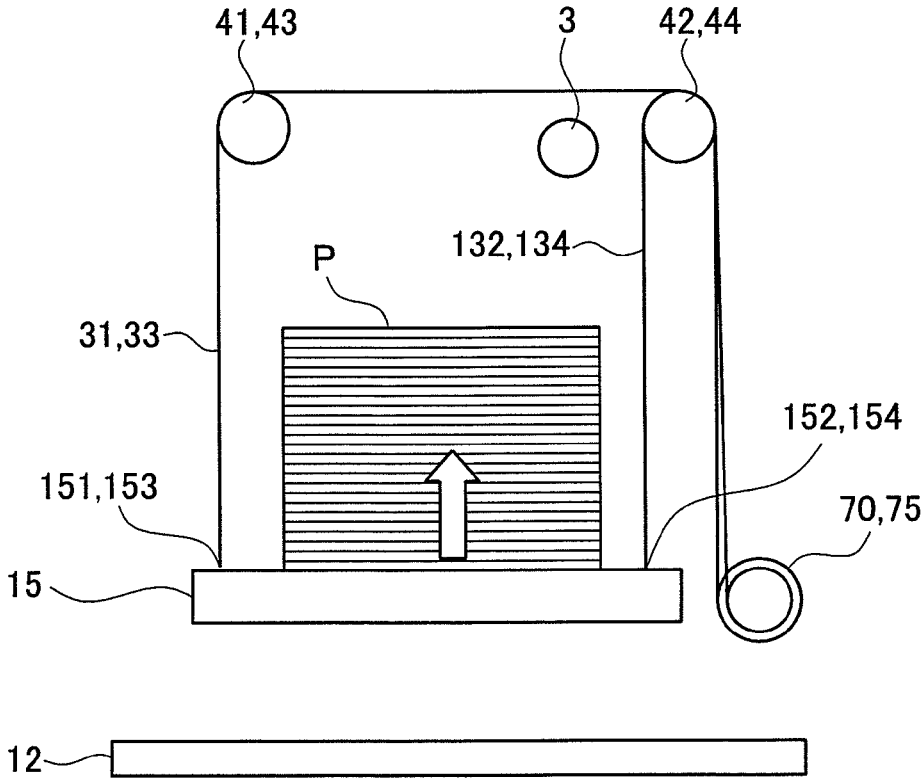
FIG. 17 is a schematic diagram (Part 2) to explain the posture of the lifting plate during upward and downward movement in the second embodiment.

FIG. 17 shows a situation that the lifting plate 15 becomes just horizontal. In this situation, the end portion of the lifting plate 15 close to the hooks 152 and 154 is naturally the same height (level) as the end portion of the lifting plate 15 close to the hooks 151 and 153. The height of the lifting plate 15 in this situation corresponds to a boundary between the zone B1 and the zone B2 in terms of FIG. 15. In other words, at that point wire winding in the different radius zone providing a difference in radius between the winding threads 51 and 52 is terminated, the lifting plate 15 just becomes horizontal. Accordingly, following the state shown in FIG. 17, the lifting plate 15 moves upward while keeping its horizontal state.

Figure 18:
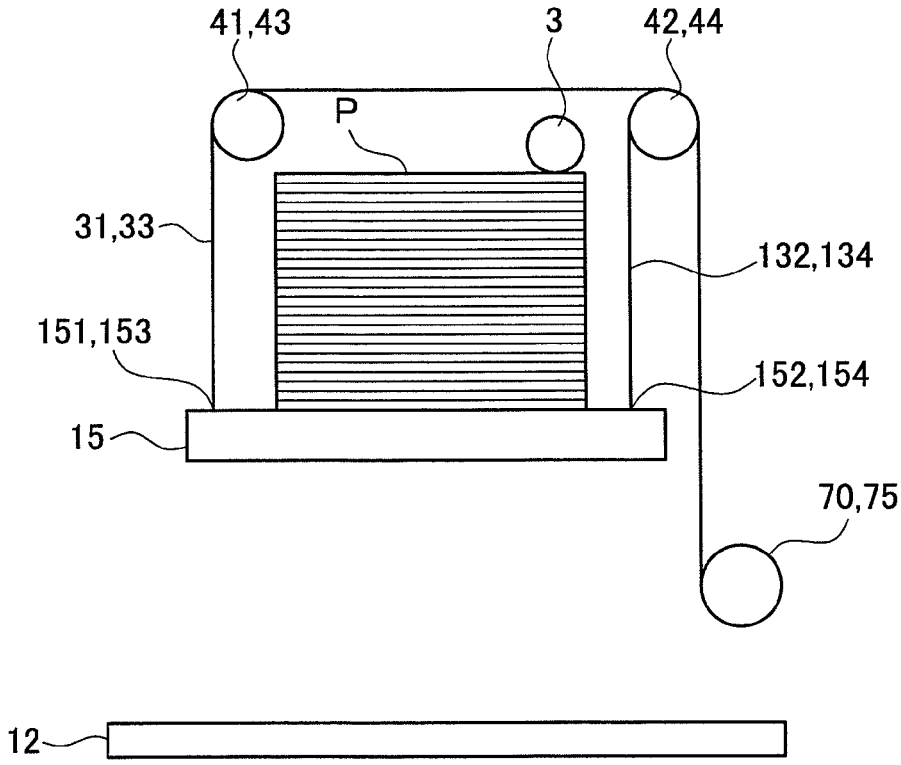
FIG. 18 is a schematic diagram (Part 3) to explain the posture of the lifting plate during upward and downward movement in the second embodiment.
Figure 19:
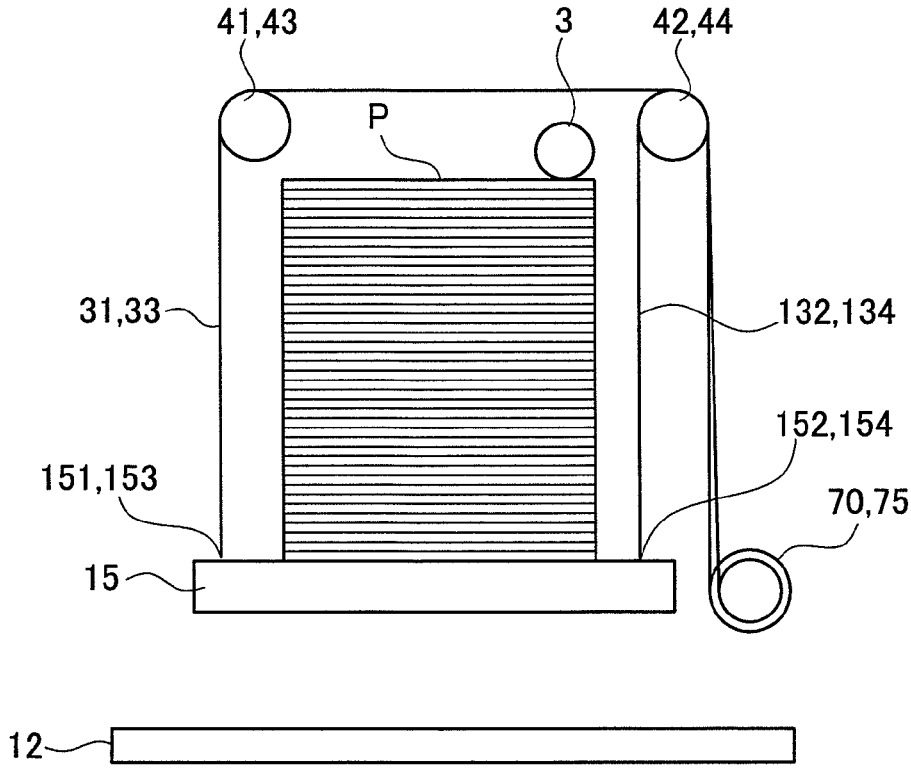
FIG. 19 is a schematic diagram (Part 4) to explain the posture of the lifting plate during upward and downward movement in the second embodiment.

FIG. 18 shows a situation that the lifting plate 15 moves upward until the uppermost sheet P contacts with the pickup roller 3. The lifting plate 15 in FIG. 18 is of course located in a higher position than in FIG. 17. In this state, supplying the sheet(s) P is enabled. Since the lifting plate 15 is horizontal in this state, the sheet(s) P is fed in a normal manner by the pick-up roller 3 and others. In the case where the amount of stacked sheets P is less than a full stacking capacity, the lifting plate 15 further moves upward as being horizontal up to a higher position than in FIG. 18. The sheet feeding height of the lifting plate 15 fully stacked thereon with the sheets P and the position at which the lifting plate 15 just becomes horizontal may be set to be equal to each other. FIG. 19 shows a state with such setting, corresponding to the states shown in FIGS. 17 and 18.

The posture of the lifting plate 15 moving downward toward the lower limit position is next explained. As mentioned above, the downward movement of the lifting plate 15 is caused by the own weight of the lifting plate 15 and the sheets P stacked thereon while the sheet tray 12 is in an opened state shown in FIG. 3. Until the lifting plate 15 comes to the height shown in FIG. 17 from the start of downward movement, the lifting plate 15 remains horizontal.

When the lifting plate 15 further moves downward from this position, the wires 132, 134, 31, and 33 are unwound from the different radius zones B1 (515 and 525 in FIG. 15). Thus, the unwinding speed of the wires 132 and 134 is faster than the unwinding speed of the wires 31 and 33. This means that the downward moving speed of the end portion of the lifting plate 15 close to the hooks 152 and 154 is faster than the downward moving speed of the end portion close to the hooks 151 and 153. Therefore, the lifting plate 15 gets inclined. The end portion close to the hooks 152 and 154 becomes naturally lower than the end portion close to the hooks 151 and 153. In this way, the lifting plate 15 comes to landing remaining inclined.

Figure 20:
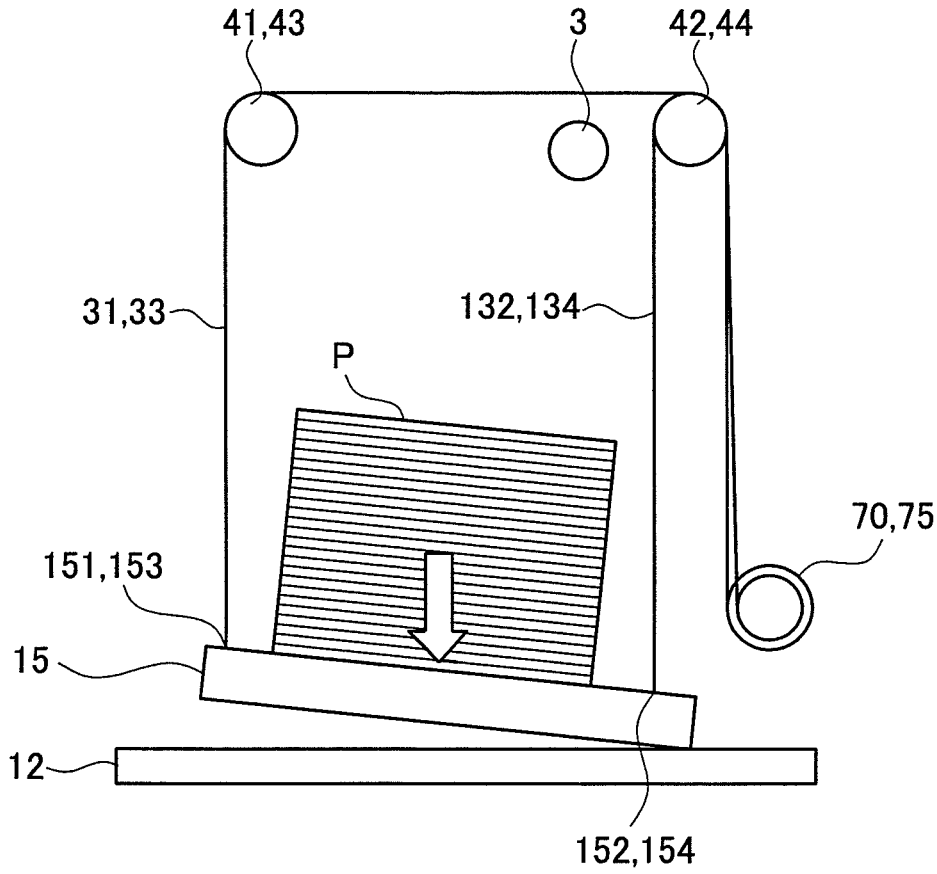
FIG. 20 is a schematic diagram (Part 5) to explain the posture of the lifting plate during upward and downward movement in the second embodiment.

As shown in FIG. 20, the end portion close to the hooks 152 and 154 first lands on the sheet tray 12. The state in FIG. 20 is equivalent to the state in FIG. 16. The end portion close to the hooks 151 and 153 also lands thereafter and thus the lifting plate 15 comes to the same state as shown in FIG. 14. That is, the whole area of the lifting plate 15 does not land simultaneously, so that impact power is mitigated. This is because the impact applied on the lifting plate 15 when landing is dispersed in time axis. This impact dispersion and the aforementioned effect in increasing the braking force U of the damper 48 contribute to largely reduce the impact on the lifting plate 15 at the time of landing.

Figure 21:
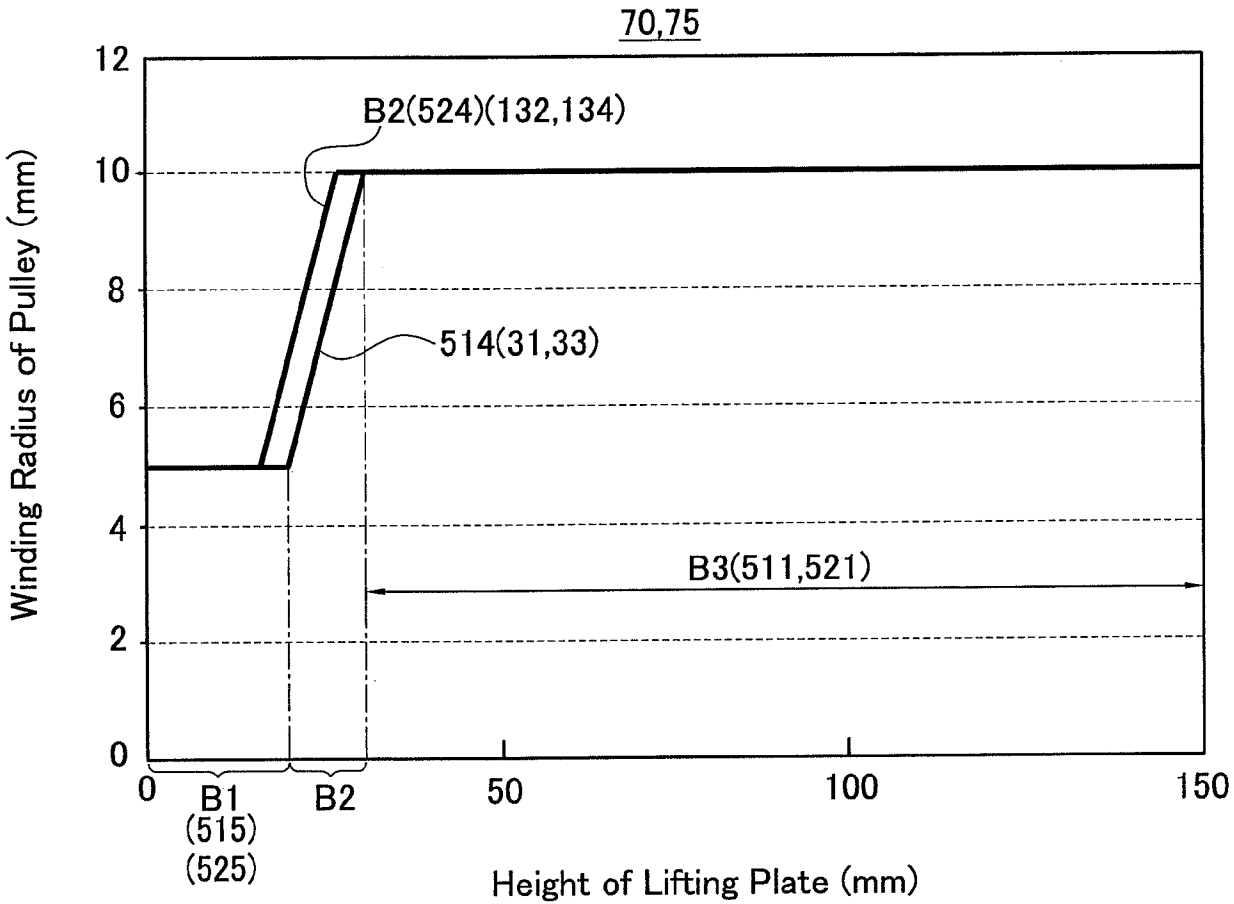
FIG. 21 is a graph showing another example of a relationship between the winding radius of the winding pulley and the height of the lifting plate in the second embodiment.

In the above configuration, the different radius zone is provided on a lower limit side in FIG. 15 in terms of the height of the lifting plate 15. This is however not essential. For instance, the different radius zone may be provided as shown in FIG. 21. In an example in FIG. 21, there is no difference in the radius of the threads 51 and 52 in the zone B1. Instead, the position of the sloping zone B2 is different between the threads 51 and 52. The sloping zone B2 (524) of the thread 52 is positioned slightly lower than the sloping zone B2 (514) of the thread 51 in terms of the height of the lifting plate 15.

Accordingly, during upward movement of the lifting plate 15, the thread 52 winding the wires 132 and 134 earlier enters the sloping zone B2 than the thread 51 winding the wires 31 and 33. During downward movement, to the contrary, the thread 51 earlier enters the sloping zone B2 than the thread 52. Thus, while the winding or unwinding of the wires 132, 134, 31, and 33 is performed by the sloping zone B2, the winding radius of the thread 52 is larger than that of the thread 51.

In the example in FIG. 21, the position on the upper limit side in the sloping zone B2 (514) corresponds to the position shown in FIG. 17, that is, the position at which the lifting plate 15 just becomes horizontal during upward movement. Thus, the position shown in FIG. 18, that is, the sheet feeding height of the fully stacked sheets is preferably equal to or above the upper limit of the sloping zone B2 (514) in FIG. 21.

The radius distribution shown in FIG. 21 is a mere example. It is only necessary to bring the lifting plate 15 in a horizontal posture during upward movement before the lifting plate 15 reaches the sheet feeding height of the fully stacked sheets. For instance, another radius distribution may be provided in which the different radius zone is set throughout the zone B1 and the zone B2 in FIG. 10.

Of the four wires, the placement of the wires having the slack V and the other wires having no slack may also be changed. Specifically, in FIG. 14, the wires 32 and 34 of the wires 31-34 in FIG. 4 have the slack V and the wires 31 and 33 have no slack V. An alternative may be arranged such that the wires 31 and 33 have the slack V and the wires 32 and 34 have no slack. Still another alternative may be arranged such that the wires 33 and 34 have the slack V and the wires 31 and 32 have no slack, or the wires 31 and 32 have the slack V and the wires 33 and 34 have no slack. In any cases, the wires having the slack V are wound up faster than the wires having no slack during upward movement of the lifting plate 15.

Furthermore, all of four wires may be slackened in the state in FIG. 14. In this case, however, two of the four wires have to be slackened more than the other two wires. In this case, the wires slackened by the same amount do not have to be placed diagonally with respect to the lifting plate 15.

In the configurations explained so far, the whole lifting plate 15 is suspended by four wires. This is not always necessary. For suspending the whole lifting plate 15, at least three wires are needed, but there is no upper limit to the number of wires. It is not always necessary that the whole lifting plate 15 is suspended. It may be arranged such that only one side of the lifting plate 15 is suspended by two wires so as to swing the lifting plate 15 around the opposite side.

In the above embodiment explained in detail above, the winding threads of the winding pulleys are provided with the winding radius distribution. This configuration causes the braking force to rise against the downward movement of the lifting plate 15 a little before the lifting plate 15 lands on the lower limit position, thereby reducing the impact at the time of landing. In the second embodiment, the lifting plate 15 is inclined at the time of landing to disperse the impact in time axis, so that the impact is further reduced. As above, the sheet feeder with a simple structure capable of rapidly lowering the lifting plate 15 and preventing impact, and the image forming apparatus incorporating the sheet feeder can be achieved. Accordingly, both rapid lowering of the lifting plate and reducing of impact at the time of landing can be achieved.

The above embodiment is a mere example and the invention is not limited to the embodiment. The present invention may be embodied in other specific forms without departing from the essential characteristics thereof. For instance, the image forming section 102 is not limited to the tandem full-color image forming device as illustrated in the drawings. A 4-cycle or monochromatic image forming device may also be adopted. The image forming method itself is not limited to the method using toner but also may be selected from other methods (e.g., a method using liquid color materials). The image forming apparatus 100 itself may be a copier or a printer. It also may be a device including a function of transmitting/receiving printing jobs via a public line.

In the sheet feeder of the present embodiment, the winding configuration section is preferably provided with a middle-position winding section between a high-position winding section and a low-position winding section to wind a wire while the lifting plate is located in a middle region located between a high-position side and a low-position side in the lifting height. A winding radius of the middle-position winding section is preferably set to decrease from the high-position winding section side to the low-position winding section side. This configuration makes the braking force gradually rise, not abruptly, against the downward movement of the lifting plate. Thus, the rising of the braking force itself does not cause impact.

In the sheet feeder of the present embodiment, furthermore, there are preferably provided a first and a second sets of the winding configuration sections and the wires; the first set comprising a first winding configuration section and a first wire to raise a first portion of the lifting plate, and the second set comprising a second winding configuration section and a second wire to raise a second portion of the lifting plate. In this case, the first and second winding configuration sections are integrally rotated. The lengths of the first and second wires are preferably set so that the first wire has a larger slack than a slack of the second wire when the lifting plate is placed in a lowest position in the lifting height. In at least a part of a region on the low-position side than the winding portion, corresponding to the middle position located between the low position and the high position in the lifting height of the lifting plate, the first and second winding configuration sections are preferably provided with the different radius zones in which the first winding configuration section has a larger diameter (radius) than the second winding configuration section in the corresponding winding positions. The first and second winding configuration sections are equal in radius at corresponding winding positions in the zones excepting the different radius zones. The different radius zones are preferably set to bring the end portion of the lifting plate close to the first-wire attaching portion and the end portion close to the second-wire attaching portion into the same height (position) while the lifting plate moves upward from the low position to the middle position in the lifting height.

By the above configuration, the lifting plate lands as inclining on the lower limit position. Accordingly, the impact at the time of landing is dispersed in time axis, so that the impact is further reduced. When the lifting plate moves upward to a certain position, the lifting plate is horizontal. Thus, no trouble occurs in sheet feeding. Herein, the situation that "the slack of the first wire is more than the slack of the second wire" includes a situation that only the first wire has slack but the second wire has no slack.

In the sheet feeder of the present embodiment, it is preferable that the middle position is a position lower than the feeding height while a maximum stacking capacity of sheets are stacked on the lifting plate. This is to normally feed the sheets even when the lifting plate is fully stacked with sheets.

More preferably, the sheet feeder of the present embodiment includes a braking device to put a brake on the movement of the winding members when the lifting plate falls down.

REFERENCE SIGNS LIST

3 Pickup roller (Feed roller)
15 Lifting plate
112 Sheet feeding unit
31, 33 Wire (Second wire)
32, 34 Wire
40, 45 Winding pulley
48 Damper
51 Winding thread (Second winding configuration section)
52 Winding thread (First winding configuration section)
70, 75 Winding pulley
102 Image forming section
132, 134 Wire (First wire)
B1 Low-position winding section (Different radius zone)
B2 Middle-position winding section (Different radius zone)
B3 High-position winding section

What is claimed is:

1. A sheet feeder including a feed roller for feeding a sheet and a lifting plate for lifting the sheet to be fed up to a feeding height for the feed roller, the device including:

a wire for raising the lifting plate; and a winding member formed with a winding configuration section for winding up the wire to raise the lifting plate, wherein the winding configuration section includes:

a high-position winding section for winding the wire while the lifting plate is located on a high-position side in a lifting height;

a low-position winding section for winding the wire while the lifting plate is located on a low-position side in the lifting height, the high-position winding section having a larger radius than a radius of the low-position winding section; and a middle-position winding section for winding the wire while the lifting plate is located in a middle region between the high-position side and the low-position side in the lifting height, the middle-position winding section being between the high-position winding section and the low-position winding section, and the middle-position winding section has a winding radius decreasing from a high-position winding section side toward a low-position winding section side.

2. The sheet feeder according to claim 1, wherein the winding configuration section and the wire include a first and a second sets; the first set comprising a first winding configuration section and a first wire to raise a first portion of the lifting plate, and the second set comprising a second winding configuration section and a second wire to raise a second portion, the first and second winding configuration sections are integrally rotated, the first and second wires have lengths determined so that the first wire has a larger slack than a slack of the second wire when the lifting plate is located in a lowest position in the lifting height, and each of the first and second winding configuration sections is provided with a different radius zone, in at least a part of a region on the low-position side than a winding position corresponding to a middle position located between a lowest position and a highest position in the lifting height of the lifting plate, the different radius zone being configured such that the first winding configuration section is larger in radius than the second winding configuration section in the corresponding winding positions, the first and second winding configuration sections are equal in radius in the corresponding winding positions in a zone other than the different diameter zone, and the different radius zone is configured such that an end portion of the lifting plate on a side attached with the first wire and an end portion on a side attached with the second wire are made equal in height while the lifting plate moves upward from the lowest position to the middle position in the lifting height.

3. The sheet feeder according to claim 2, wherein the middle position is a position equal to or lower than a feeding height of the lifting plate on which a maximum stacking capacity of sheets are stacked.

4. The sheet feeder according to claim 1, wherein the winding configuration section and the wire include a first and a second sets; the first set comprising a first winding configuration section and a first wire to raise a first portion of the lifting plate, and the second set comprising a second winding configuration section and a second wire to raise a second portion, the first and second winding configuration sections are integrally rotated, the first and second wires have lengths determined so that the first wire has a larger slack than a slack of the second wire when the lifting plate is located in a lowest position in the lifting height, and each of the first and second winding configuration sections is provided with a different radius zone, in at least a part of a region on the low-position side than a winding position corresponding to a middle position located between a lowest position and a highest position in the lifting height of the lifting plate, the different radius zone being configured such that the first winding configuration section is larger in radius than the second winding configuration section in the corresponding winding positions, the first and second winding configuration sections are equal in radius in the corresponding winding positions in a zone other than the different diameter zone, and the different radius zone is configured such that an end portion of the lifting plate on a side attached with the first wire and an end portion on a side attached with the second wire are made equal in height while the lifting plate moves upward from the lowest position to the middle position in the lifting height.

5. The sheet feeder according to claim 4, wherein the middle position is a position equal to or lower than a feeding height of the lifting plate on which a maximum stacking capacity of sheets are stacked.

6. The sheet feeder according to claim 1, further including a braking device for braking movement of the winding member during downward movement of the lifting plate.

7. The sheet feeder according to claim 1, further including:

a motor for driving the winding member to rotate; and a transmission member selectively placed in a connected state for transmitting rotation power of the motor to the winding member and a separated state for not transmitting the rotation power.

8. The sheet feeder according to claim 7, wherein the lifting plate moves downward to a lowest position in the lifting height when the transmission member is placed in the separated state.

9. The sheet feeder according to claim 8, further including a braking device for braking movement of the winding member during downward movement of the lifting plate.

10. The sheet feeder according to claim 9, wherein the transmission member includes a driving member on a motor side and a driven member on a winding member side, the driving member and the driven member having recesses and protrusions engageable with each other, and the transmission member in the connected state where the recesses and the protrusions are engaged transmits the rotation power, and the transmission member in the separated state where the driven member and the driving member are separated from each other to disengage the recesses and the protrusions disables transmission of the rotation power.

11. The sheet feeder according to claim 10, further including a sheet tray being able to be pulled out from a main body of the apparatus, wherein the lifting plate and the winding member are configured to be pulled out together when the sheet tray is pulled out, and the transmission member is placed in the separated state when the sheet tray is pulled out but is placed in the connected state when the sheet tray is pushed in.

12. The sheet feeder according to claim 8, wherein the transmission member includes a driving member on a motor side and a driven member on a winding member side, the driving member and the driven member having recesses and protrusions engageable with each other, and the transmission member in the connected state where the recesses and the protrusions are engaged transmits the rotation power, and the transmission member in the separated state where the driven member and the driving member are separated from each other to disengage the recesses and the protrusions disables transmission of the rotation power.

13. The sheet feeder according to claim 12, further including a sheet tray being able to be pulled out from a main body of the apparatus, wherein the lifting plate and the winding member are configured to be pulled out together when the sheet tray is pulled out, and the transmission member is placed in the separated state when the sheet tray is pulled out but is placed in the connected state when the sheet tray is pushed in.

14. An image forming apparatus including:

the sheet feeder according to claim 1; and an image forming section for forming an image on a sheet supplied from the sheet feeder.

15. The image forming apparatus according to claim 14, further including:

a motor for driving the winding member to rotate; and a transmission member selectively placed in a connected state for transmitting rotation power of the motor to the winding member and a separated state for not transmitting the rotation power, wherein the lifting plate moves downward to a lowest position in the lifting height when the transmission member is placed in the separated state.

16. The image forming apparatus according to claim 15, wherein the transmission member includes a driving member on a motor side and a driven member on a winding member side, the driving member and the driven member having recesses and protrusions engageable with each other, and the transmission member in the connected state where the recesses and the protrusions are engaged transmits the rotation power, and the transmission member in the separated state where the driven member and the driving member are separated from each other to disengage the recesses and the protrusions disables transmission of the rotation power.

17. The image forming apparatus according to claim 16, further including a sheet tray being able to be pulled out from a main body of the apparatus, wherein the lifting plate and the winding member are configured to be pulled out together when the sheet tray is pulled out, and the transmission member is placed in the separated state when the sheet tray is pulled out but is placed in the connected state when the sheet tray is pushed in.

18. The sheet feeder according to claim 1, wherein the winding radius of the high-position winding section is constant.

19. A sheet feeder including a feed roller for feeding a sheet and a lifting plate for lifting the sheet to be fed up to a feeding height for the feed roller, the device including:

a wire for raising the lifting plate;

a winding member formed with a winding configuration section for winding up the wire to raise the lifting plate, wherein the winding configuration section includes:

a high-position winding section for winding the wire while the lifting plate is located on a high-position side in a lifting height, and a low-position winding section for winding the wire while the lifting plate is located on a low-position side in the lifting height, the high-position winding section having a larger radius than a radius of the low-position winding section;

a motor for driving the winding member to rotate; and a transmission member selectively placed in a connected state for transmitting rotation power of the motor to the winding member and a separated state for not transmitting the rotation power, wherein the transmission member includes a driving member on a motor side and a driven member on a winding member side, the driving member and the driven member having recesses and protrusions engageable with each other, and the transmission member in the connected state where the recesses and the protrusions are engaged transmits the rotation power, and the transmission member in the separated state where the driven member and the driving member are separated from each other to disengage the recesses and the protrusions disables transmission of the rotation power.

20. The sheet feeder according to claim 19, further including a sheet tray being able to be pulled out from a main body of the apparatus, wherein the lifting plate and the winding member are configured to be pulled out together when the sheet tray is pulled out, and the transmission member is placed in the separated state when the sheet tray is pulled out but is placed in the connected state when the sheet tray is pushed in.

* * * * *